US007554457B2

(12) United States Patent
Hounschell, II

(10) Patent No.: US 7,554,457 B2
(45) Date of Patent: Jun. 30, 2009

(54) SYSTEM AND METHOD FOR SENSING MISALIGNMENT OF A RAILROAD SIGNALING SYSTEM

(75) Inventor: John Charles Hounschell, II, Grain Valley, MO (US)

(73) Assignee: General Electric Company, Schenectady, NY (US)

( * ) Notice: Subject to any disclaimer, the term of this patent is extended or adjusted under 35 U.S.C. 154(b) by 277 days.

(21) Appl. No.: 11/733,807

(22) Filed: Apr. 11, 2007

(65) Prior Publication Data

US 2008/0252480 A1 Oct. 16, 2008

(51) Int. Cl.
*G08B 21/00* (2006.01)

(52) U.S. Cl. ..... 340/686.2; 340/686.3; 246/125; 246/127

(58) Field of Classification Search ..... 340/540, 340/686.2, 908.1, 641, 686.3, 686.4, 691.1, 340/692, 691.7, 870.03, 907, 916, 927; 246/169 R, 246/121, 125, 127, 473, 477; 707/1, 57; 49/49, 192; 200/61.45 R, 61.52; 356/138
See application file for complete search history.

(56) References Cited

U.S. PATENT DOCUMENTS

| | | | | |
|---|---|---|---|---|
| 3,891,175 | A * | 6/1975 | Hawley et al. | 248/317 |
| 3,974,991 | A | 8/1976 | Geiger | |
| 4,290,607 | A | 9/1981 | McDonald | |
| 4,415,134 | A | 11/1983 | Wilson | |
| 5,178,349 | A | 1/1993 | Marengo | |
| 5,231,808 | A | 8/1993 | Angelette | |
| 5,415,369 | A | 5/1995 | Hungate | |
| 5,556,070 | A * | 9/1996 | Viebrock | 248/469 |
| 5,746,036 | A | 5/1998 | Angelette | |
| 6,399,875 | B1 | 6/2002 | Silvers | |
| 6,463,337 | B1 | 10/2002 | Walker | |
| 6,540,180 | B2 * | 4/2003 | Anderson | 246/120 |
| 6,586,671 | B1 | 7/2003 | Kelley et al. | |
| 6,734,575 | B2 | 5/2004 | Ricketts | |
| 6,963,202 | B2 | 11/2005 | Winkler et al. | |
| 7,053,784 | B2 * | 5/2006 | Hatfield et al. | 340/686.1 |
| 7,072,562 | B2 | 7/2006 | Domres et al. | |
| 2005/0099319 | A1 | 5/2005 | Hutchinson et al. | |
| 2005/0237215 | A1 | 10/2005 | Hatfield et al. | |
| 2006/0261218 | A1 * | 11/2006 | Mace et al. | 246/169 R |
| 2008/0303656 | A1 * | 12/2008 | Mathews et al. | 340/540 |

FOREIGN PATENT DOCUMENTS

| | | |
|---|---|---|
| FR | 2 743 437 | 7/1997 |
| GB | 2 394 592 | 4/2004 |
| WO | WO 2007/005877 | 1/2007 |

* cited by examiner

*Primary Examiner*—Toan N Pham
(74) *Attorney, Agent, or Firm*—Robert Wawrzyn, Esq.; Terry M. Sanks, Esq.; Beusse Wolter Sanks Mora & Maire, P.A.

(57) ABSTRACT

A system is provided for sensing misalignment of a railroad signaling system. The railroad signaling system includes at least one railroad signal coupled to at least one elongated member adjacent to a railroad. The system includes at least one transmitter positioned within at least one elongated member, and at least one receiver positioned from each of said at least one transmitter within at least one adjacent elongated member to the at least one elongated member. More particularly, the system includes at least one electronic device coupled to each of a transmitter and each of at least one receiver, to sense detection of each transmitter by at least one receiver of at least one receiver indicative of misalignment of the railroad signaling system.

29 Claims, 6 Drawing Sheets

SYSTEM AND METHOD FOR SENSING MISALIGNMENT OF A RAILROAD SIGNALING SYSTEM

FIELD OF THE INVENTION

The present invention relates to the railroad signaling systems, and more particularly, to a system, method and computer readable media for sensing misalignment of a railroad signaling system.

BACKGROUND OF THE INVENTION

Railroad signaling systems, including railroad crossing signals positioned adjacent to the intersection of railroads and roadways, and signaling systems positioned adjacent to railroads, are used for various functions. For example, railroad crossing signals are typically aligned with the roadway intersecting a railroad, and serve to warn drivers of automobiles and pedestrians of an oncoming train. Railroad crossing signals may be positioned along various vertical, horizontal and diagonal bars of a railroad signaling system, and typically flash on and off with a reddish color. As another example, signaling systems are typically aligned with a railroad, and serve to warn a locomotive operator of an upcoming condition, such as no authorization to proceed, or restricted authorization to proceed, for example. Typical signaling systems include green, yellow and red colors indicative of respective safe and unsafe conditions.

Railroad signaling systems, including railroad crossing signals and signaling systems, depend on various factors for their effectiveness. One such factor includes proper alignment. For example, a railroad crossing signal may become misaligned and not align with the roadway intersecting the railroad, thereby failing to provide the necessary warning to drivers and pedestrians of an upcoming train and creating a safety hazard. Such misalignment of a railroad crossing signal may arise from one of several causes, such as being struck by a passing train, being struck by a passing vehicle such as a truck, harsh weather and wind, or vandalism. Additionally, the signaling systems are equally vulnerable to such misalignment, thereby failing to provide a necessary warning to a locomotive operator on an upcoming locomotive, or similar unsafe condition.

Currently, the FRA (Federal Railroad Administration) enact regulations to ensure that each railroad crossing signal and signaling system are properly aligned within an acceptable and safe range. Additionally, FRA regulations require that a maintenance worker regularly travels to railroad crossing signals and signaling systems, and manually checks each railroad signal for proper alignment. In some cases, the railroad signaling systems are extremely remote, and thus the accumulating high cost and inefficiency of such regular manual alignment checks is extensive.

Accordingly, it would be advantageous, both in terms of cost and time efficiency, to provide a system for automatically sensing misalignment of railroad signaling systems, without the need for such regular manual alignment checks.

BRIEF DESCRIPTION OF THE INVENTION

In one embodiment of the present invention, a system is provided for sensing misalignment of a railroad signaling system. The railroad signaling system includes at least one railroad signal coupled to at least one elongated member adjacent to a railroad. The system includes at least one transmitter positioned within at least one elongated member, and at least one receiver positioned from each transmitter within at least one elongated member. More particularly, the system includes at least one electronic device coupled to each of the at least one receiver, to sense detection of each transmitter by at least one receiver of the at least one receiver indicative of misalignment of the railroad signaling system.

In another embodiment of the present invention, a method is provided for sensing misalignment of a railroad signaling system. The railroad signaling system includes at least one railroad signal coupled to at least one elongated member adjacent to a railroad. The method includes the steps of positioning at least one transmitter within at least one elongated member, and positioning at least one receiver from each transmitter within at least one elongated member. More particularly, the method includes coupling at least one electronic device to each of the at least one receiver, to sense detection of each transmitter by at least one receiver of the at least one receiver indicative of misalignment of the railroad signaling system.

In another embodiment of the present invention, computer readable media containing program instructions are provided for sensing misalignment of a railroad signaling system. The railroad signaling system includes at least one railroad signal coupled to at least one elongated member adjacent to a railroad. The computer readable media includes a computer program code to sense detection of at least one transmitter within at least one elongated member by at least one receiver within each elongated member indicative of the misalignment of the railroad signaling system.

BRIEF DESCRIPTION OF THE DRAWINGS

A more particular description of the invention briefly described above will be rendered by reference to specific embodiments thereof that are illustrated in the appended drawings. Understanding that these drawings depict only typical embodiments of the invention and are not therefore to be considered to be limiting of its scope, the embodiments of the invention will be described and explained with additional specificity and detail through the use of the accompanying drawings in which.

DETAILED DESCRIPTION OF THE INVENTION

Figure 1:
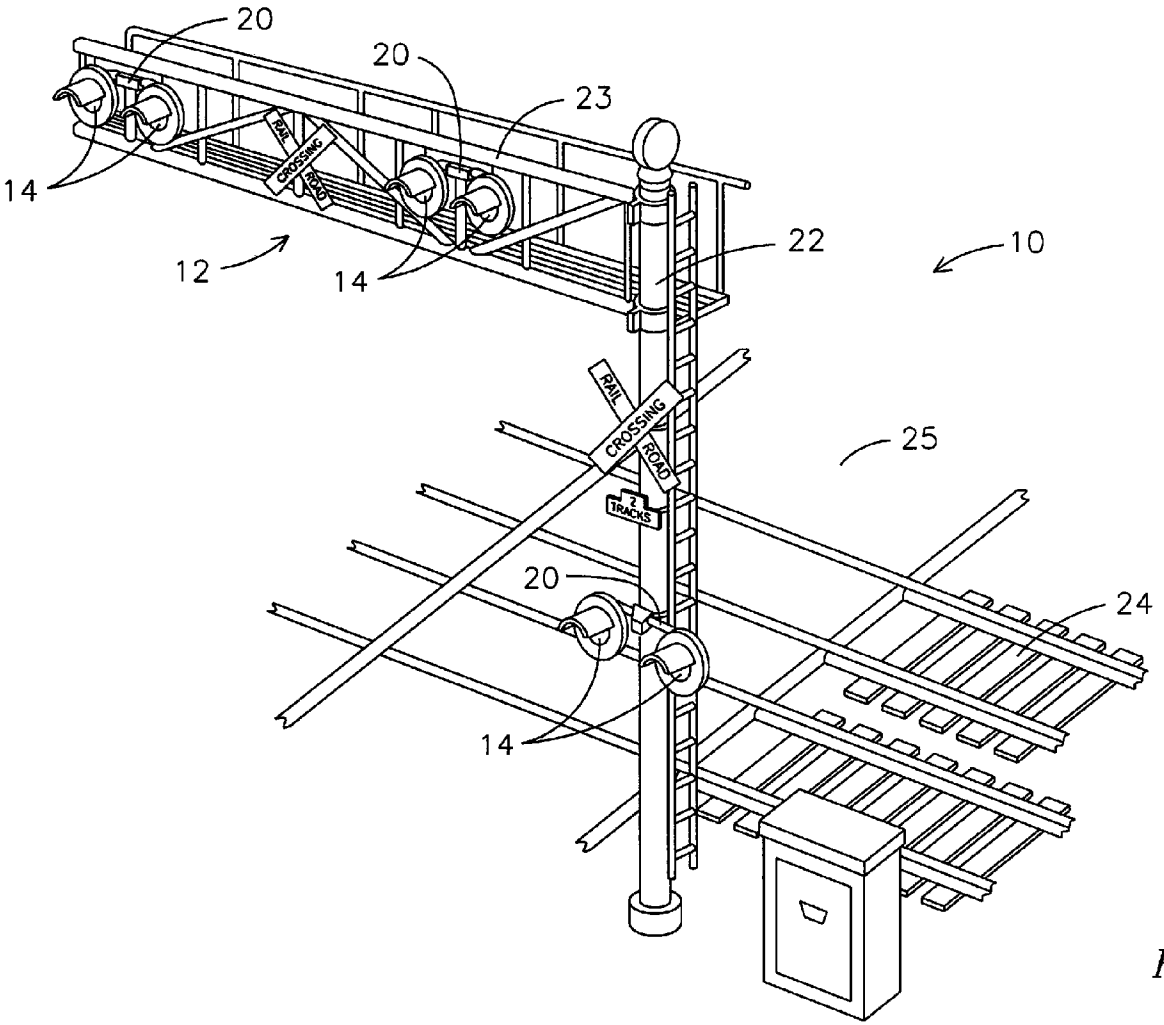
FIG. 1 is a perspective view of an embodiment of a system for sensing misalignment of a railroad signaling system according to the present invention.
Figure 2:
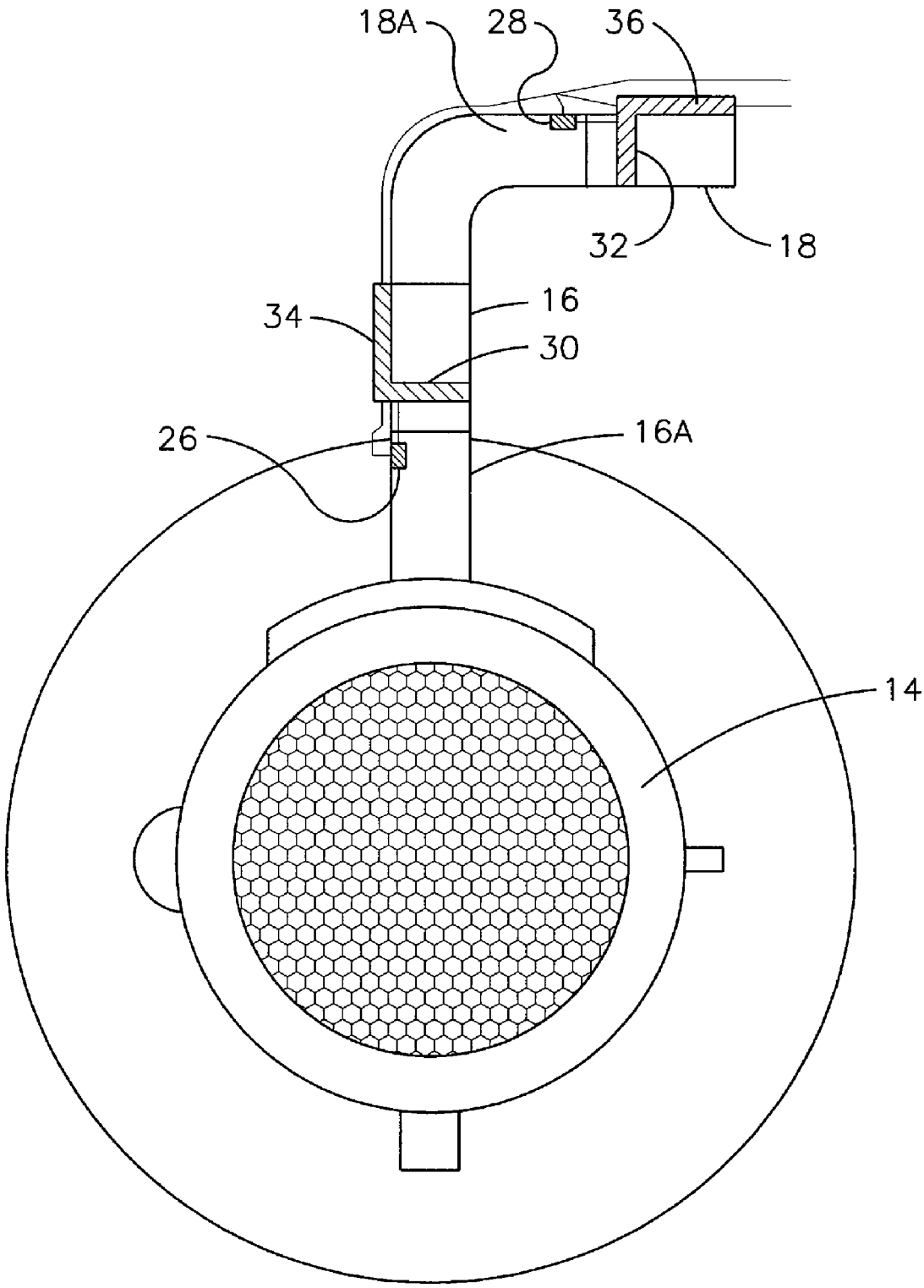
FIG. 2 a partial front sectional view of a system for sensing misalignment of a railroad signaling system shown in FIG. 1.

FIG. 1 illustrates a system 10 to sense misalignment of a railroad signaling system 12. The railroad signaling system 12 illustratively includes a plurality of railroad signals 14 coupled to a plurality of elongated members 16A,16,18A,18, 20,22 adjacent to a railroad 24. In the illustrated exemplary embodiment of FIGS. 1-2, the plurality of elongated members 16,16A,18,18A,20,22 include vertical tubes 16,16A extending from each railroad signal 14, horizontal tubes 18,18A connected to the vertical tubes 16,16A, a horizontal bar 20 coupled to the horizontal tubes 18A,18 and a vertical bar 22 coupled to the horizontal bar which extends into the ground adjacent to the railroad 24. The vertical tube 16A and horizontal tube 18A are positioned respectively adjacent to the vertical tube 16 and horizontal tube 18, as illustrated in FIG. 2. Although FIGS. 1-2 illustrate a plurality of horizontal tubes and vertical tubes, one horizontal tube and one vertical tube may be utilized. The system 10 is not limited to the specific railroad signaling system 12 arrangement of elongated members 16,16A,18,18A,20,22 in the illustrated exemplary embodiment of FIGS. 1-2, and may be utilized with a railroad signaling system including elongated members without a horizontal bar, vertical bar, and having diagonal bars, or any arrangement of elongated members supporting a plurality of railroad signals. Additionally, although FIG. 1 illustrates a plurality of elongated members supporting a plurality of railroad signals, the system 10 may be utilized with a single elongated member or a single railroad signal, as appreciated by one of skill in the art.

The system 10 may be used to sense misalignment of a variety of railroad signaling systems 12. For example, the system 10 may be used to sense misalignment of a railroad signaling system, such as the railroad crossing signaling system 12 illustrated in FIG. 1, with the roadway 25. The system 10 may achieve a proper alignment such that pedestrians and drivers in cars on the roadway 25 approaching the railroad 24 clearly see the railroad signals 14. Additionally, the system 10 may be used to sense misalignment of a railroad signaling system, such as a signaling system aligned along a railroad such that operators of locomotives traveling along the railroad clearly see the railroad signals, as appreciated by one of skill in the art.

As illustrated in FIGS. 1-2, the system 10 includes a transmitter 26,28 respectively positioned within each vertical tube 16 and horizontal tube 18. Additionally, the system includes a plurality of receivers 30,32 proximately positioned from each respective transmitter 26,28 within each of the vertical tube 16 and horizontal tube 18. More particularly, the system 10 further illustratively includes an electronic device 34 respectively coupled to each plurality of receivers 30,32 and each respective transmitter 26,28. Each electronic device 34 is used to sense detection of each transmitter 26,28 by a respective plurality of receivers 30,32 as indicative of misalignment of the railroad signaling system 12.

Figure 3:
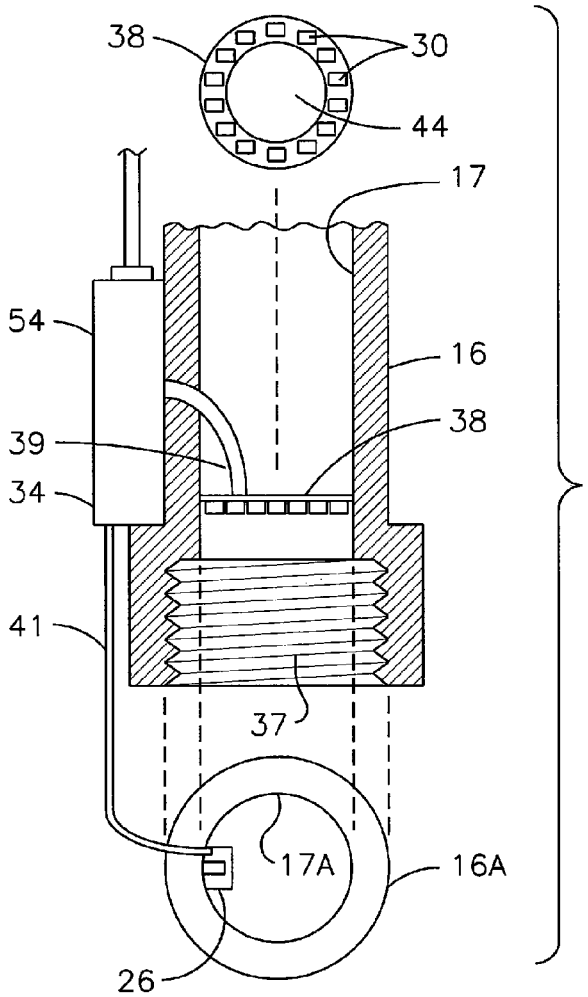
FIG. 3 is a cross-sectional exploded view of a system for sensing misalignment of a railroad signaling system shown in FIG. 1.

Although FIGS. 1-2 illustrate a single transmitter 26,28 respectively positioned within each vertical tube 16A and horizontal tube 18A and proximately positioned from a respective plurality of receivers 30,32, more than one transmitter may be proximately positioned from a respective plurality of receivers within each adjacent vertical tube and horizontal tube. Additionally, although FIGS. 1-3 illustrate a transmitter and plurality of receivers within respective vertical tubes 16 and 16A and horizontal tubes 18 and 18A, the respective transmitter and plurality of receivers may be positioned within elongated members other than the vertical tube and horizontal tube. Although FIG. 2-3 illustrate a single electronic device 34,36 respectively coupled to each transmitter and plurality of receivers 30,32, more than one electronic device may be respectively coupled to each transmitter and plurality of receivers.

In an exemplary embodiment of the present invention, each transmitter 26,28 and each plurality of receivers include a respective LED (light emitting diode) transmitter and plurality of LED receivers, and such LED transmitters and LED receivers may have a narrow angle spread.

As illustrated in the exemplary embodiment of FIG. 3, the transmitter 26 is mounted within the vertical tube 16A on an inside surface 17A of the vertical tube. Although horizontal tubes 18 and 18A are not illustrated in FIG. 3, the mounting of the transmitter 28 and plurality of receivers 32 to the horizontal tubes 18A and 18 is similar to that of the vertical tubes 16A and 16 shown in FIG. 3, and requires no further discussion herein. As illustrated in the exemplary embodiment of FIG. 3, vertical tube 16A is threaded into vertical tube 16 using a plurality of inner threads 37 along the vertical tube 16A. However, as one of skill in the art will readily appreciate, several connecting structures and methods may be utilized to securely connect the vertical tubes 16A,16 together. The transmitter 26 may be mounted to the inside surface 17A of the vertical tube 16A using any method appreciated by one of skill in the art. In an exemplary embodiment, in mounting the transmitter and receivers to the inside surfaces of the vertical tubes, each vertical tube may include a molded device with a mounting arrangement for the respective plurality of receivers and transmitter. Alternatively, each vertical tube may be designed such that the respective receivers and transmitter are screw mounted or glued to the tube, or mounted using any other method appreciated by one of skill in the art. Additionally, the respective plurality of receivers 30 are mounted on a ring 38, which is also coupled to the inside surface 17 of the vertical tube 16. Although FIG. 3 illustrates a ring to mount the plurality of receivers 30, the plurality of receivers may be mounted to any member having any shape, provided the member may be securely coupled to the inside surface of the vertical tube and includes a center opening to facilitate passage of the railroad signal cable, as discussed below. Additionally, although the exemplary embodiment of FIG. 3 illustrates the plurality of receivers 30 arranged in a regular, single row circular arrangement around the ring 38, the plurality of receivers may be arranged in any arrangement around the ring such that sensing the detection of the transmitter by the plurality of receivers is indicative of misalignment of the railroad signaling system.

Figure 4:
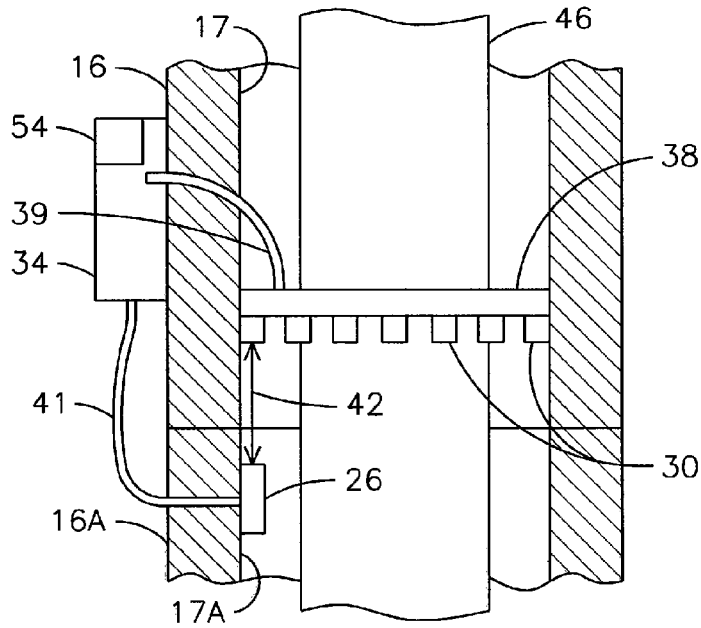
FIG. 4 is a partial top cross-sectional view of a system for sensing misalignment of a railroad signaling system shown in FIG. 1.

As illustrated in the exemplary embodiment of FIG. 4, the transmitter 26 is illustratively mounted to the inside surface 17A of the vertical tube 16A and the plurality of receivers 30 are mounted on the ring 38 coupled to the inside surface of the adjacent vertical tube 17. Although the horizontal tubes 18 and 18A are not illustrated in FIG. 4, the mounting of the transmitter 28 and plurality of receivers 32 to the horizontal tube 18A and 18 is similar to that of the vertical tube 16A and 16 shown in FIG. 4, and requires no further discussion herein. Additionally, as illustrated in FIG. 4, the transmitter 26 and plurality of receivers 30 are proximately separated by a proximate distance 42 based upon the narrow angle spread of each LED transmitter 26 and plurality of LED receivers 30 of the illustrated exemplary embodiment. In one exemplary embodiment of the present invention, the proximate distance separating the LED transmitter and plurality of LED receivers may be inversely proportional to the LED transmitter and LED receiver angular spread. More particularly, as illustrated in the exemplary embodiment of FIG. 4, the ring 38 is coupled to the inside surface 17 of the vertical tube 16 and includes a center hole 44 (FIG. 3) sized to facilitate passage of one or more cables 46 through the vertical tubes 16 and 16A to the railroad signal 14 (FIG. 2). In the exemplary embodiment of FIG. 4, the electronic device 34 is electrically coupled to the plurality of receivers 30 via a wire coupling 39 to the ring 38, as each receiver is electrically coupled to the ring. The electronic device 34 is similarly electrically coupled to the transmitter 26 via the wire coupling 41, or powers transmitter cable.

As illustrated in the exemplary embodiment of FIG. 2, a transmitter 26 and respective plurality of receivers 30 are positioned within the vertical tubes 16 and 16A to sense horizontal misalignment of the railroad signal 14. Additionally, a transmitter 28 and respective plurality of receivers 32 are positioned within the horizontal tubes 18A and 18 to sense vertical misalignment of the railroad signal 14.

Figure 5:
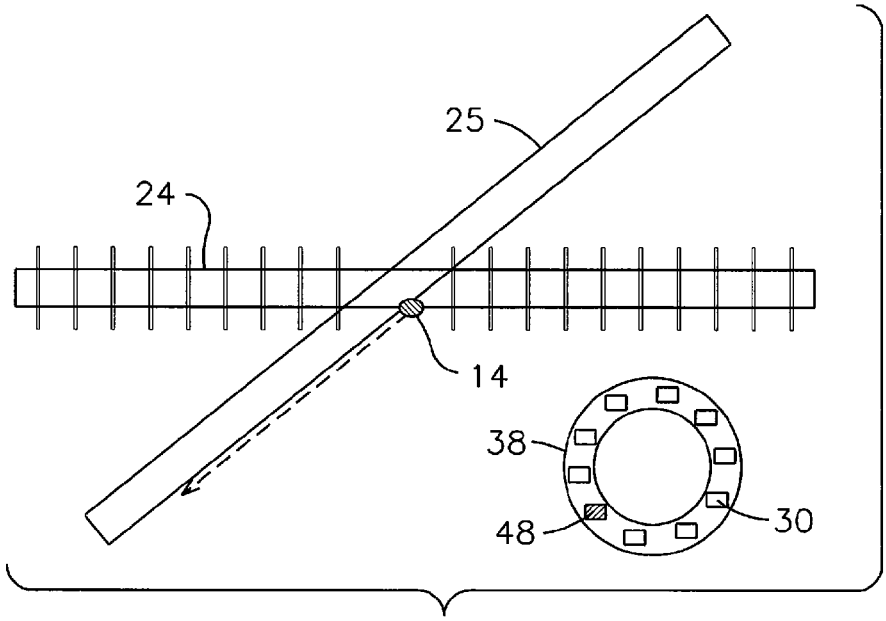
FIG. 5 is a top view of an embodiment of a system for sensing misalignment of a railroad signaling system according to the present invention.
Figure 6:
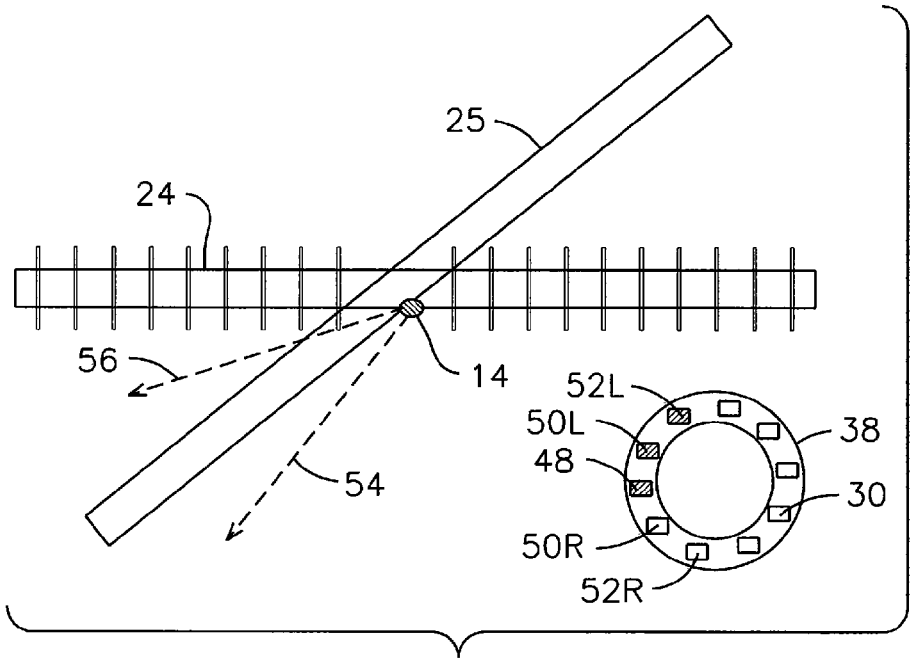
FIG. 6 is a top view of an embodiment of a system for sensing misalignment of a railroad signaling system according to the present invention.

In one embodiment of the system 10, the electronic device 34,36 senses detection of a respective transmitter 26, 28 by a respective plurality of receivers 30,32 indicative of misalignment of the railroad signaling system 12. The electronic device 34,36 senses detection of each respective transmitter 26,28 by sensing a variation in the detection of each respective transmitter 26,28 by each respective plurality of receivers 30,32. As illustrated in the exemplary embodiment of FIGS. 5-6, the railroad signal 14 undergoes a misalignment from being aligned with the roadway 25 (FIG. 5) to undergoing horizontal misalignment and becoming misaligned from the roadway 25 (FIG. 6). As illustrated in FIG. 3, the electronic device 34 senses a horizontal misalignment of the railroad signal 14 within the vertical tube 16. As illustrated in FIGS. 3, 5 and 6, the electronic device 34 senses a variation in the detection of a respective transmitter 26 by a respective plurality of receivers 30 through sensing a variation from a single receiver 48 detecting the transmitter to either at least one adjacent receiver 50L or 50R detecting the transmitter or a plurality of receivers 48,50L,52L or 48,50R,52R detecting the transmitter based upon a respective misalignment 54,56 of the railroad signal 12. The illustrated exemplary embodiment of FIGS. 5-6 illustrate the electronic device 34 sensing a variation in the detection of the transmitter 26 by the receivers 30 from the single receiver 48 to the adjacent receivers 50L,52L based upon a misalignment 54 of the railroad signal 12. However, the electronic device 34 would sense a variation in the detection of the transmitter 26 by the receivers 30 from the single receiver 48 to the adjacent receivers 50R,52R based upon a misalignment 56 of the railroad signal 12. Although FIGS. 5-6 illustrate the electronic device sensing a variation in the detection of a transmitter from a single receiver to a plurality of receivers or at least one adjacent receiver, the electronic device may sense a variation in the detection of a transmitter from a first plurality of receivers to a second plurality of receivers, or by evaluating the receiving distribution between a plurality of receivers before and after the variation in the detection of the transmitter.

As illustrated in FIGS. 3 and 5-6, the electronic device 34 is switchable between a calibration mode to sense a proper alignment of the transmitter 26 by a calibration receiver 48 of the plurality of receivers. Upon sensing the proper alignment of the transmitter 26, the electronic device 34 records proper alignment data in a memory 54 within the electronic device including the identity of the calibration receiver 48. Upon recording the proper alignment data within the memory 54, the electronic device 34 switches from the calibration mode into a detection mode to sense detection of the transmitter 26 indicative of misalignment of the railroad signaling system 12. Although FIGS. 5-6 illustrate a single calibration receiver 48, more than one calibration receiver may be used.

In addition to the proper alignment data, the memory 54 stores misalignment threshold granularity to determine whether sensing detection of the transmitter 26 by the plurality of receivers 30 is indicative of the misalignment. In an exemplary embodiment of the system 10 illustrated in FIGS. 5-6, the misalignment threshold granularity includes a maximum number of adjacent receivers 50L or 50R from the calibration receiver 48 to detect the transmitter 26 beyond which is indicative of misalignment. Accordingly, in the illustrated exemplary embodiment of FIGS. 5-6, as the vertical tube 16 (and horizontal alignment of the railroad signal 14) progressed from proper alignment (FIG. 5) to misalignment 54,56 (FIG. 6), the electronic device 34 senses a variation in the detection of the transmitter 26 from the calibration receiver 48 to a plurality of receivers 48,50L,52L or 48,50R, 52R, which extend beyond the maximum number of adjacent number of receivers 50L or 50R stored in the memory 54 (i.e., one) from the calibration receiver 48, thereby indicating misalignment of the vertical tube 16 (and railroad signaling system 12). The misalignment threshold granularity, including a maximum number of adjacent receivers from the calibration receiver, may correspond to a maximum rotational deviation of the vertical tube indicative of misalignment in angular units of measure, and such maximum rotational deviation may additionally be stored in the memory.

In an exemplary embodiment of the system 10, the electronic device 34 is further switchable from the detecting mode to an alert mode upon detecting misalignment of the railroad signaling system 12. Upon switching to the alert mode, the electronic device 34 communicates an alert signal to a remote terminal to arrange for realignment of the railroad signaling system 12. The electronic device 36 similarly switches between a calibration mode, detection mode, and alert mode in response to vertical misalignment, as the electronic device 34 with horizontal misalignment discussed above, and thus requires no further discussion herein.

Figure 7:
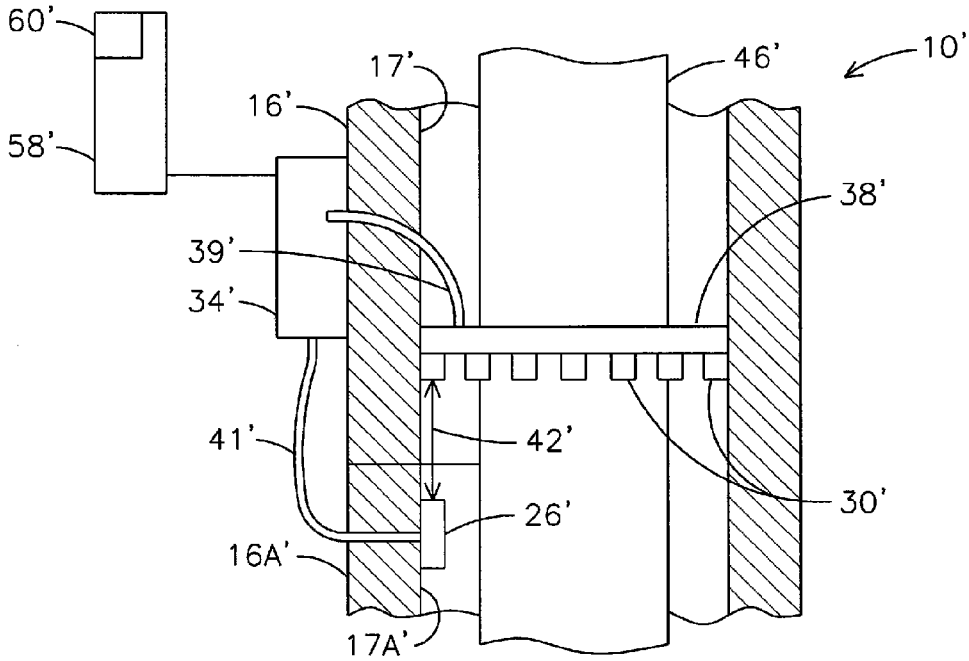
FIG. 7 is a partial top cross-sectional view of a system for sensing misalignment of a railroad signaling system according to the present invention.

In another embodiment of a system 10' of the present invention illustrated in FIG. 7, the system includes a processor 58' coupled to the electronic device 34' to receive sensed detection information of the transmitter 26' by the plurality of receivers 30'. The system 10' may be used to sense misalignment of a variety of railroad signaling systems 12'. For example, the system 10' may be used to sense misalignment of a railroad signal 14', such as the railroad signal 14' illustrated in FIG. 8, with the roadway 25'. As illustrated in the exemplary embodiment of FIGS. 7-9, the processor 58' is switchable to a calibration mode to receive the identity of a calibration receiver 48' when sensing a proper alignment of the transmitter 26' in the calibration mode. The processor 58' illustratively includes a memory 60' to store proper alignment data including the identity of the calibration receiver 48'. Upon recording the proper alignment data within the memory 60', the processor 58' switches from the calibration mode into a detection mode to receive sensed detection information from the electronic device 34' of the transmitter 26' by the plurality of receivers 30' indicative of misalignment of the railroad signaling system 12'.

Figure 8:
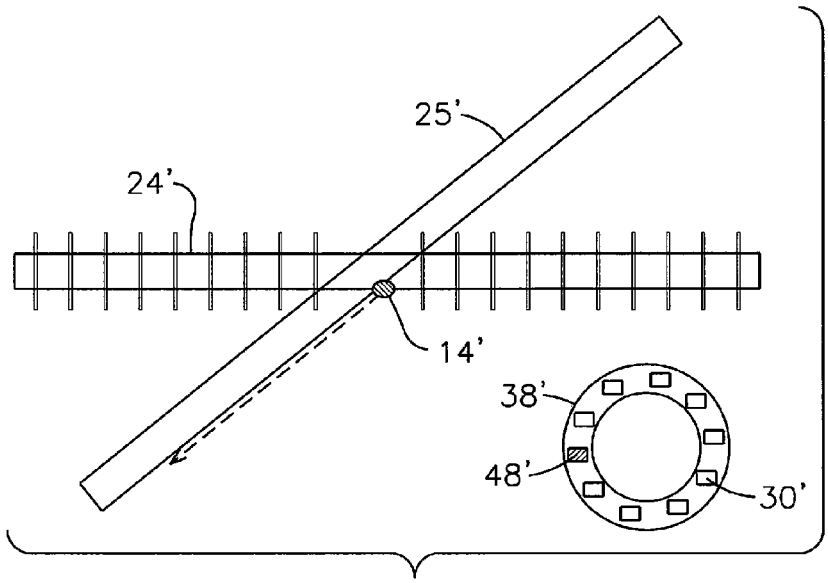
FIG. 8 is a top view of an embodiment of a system for sensing misalignment of a railroad signaling system according to the present invention.
Figure 9:
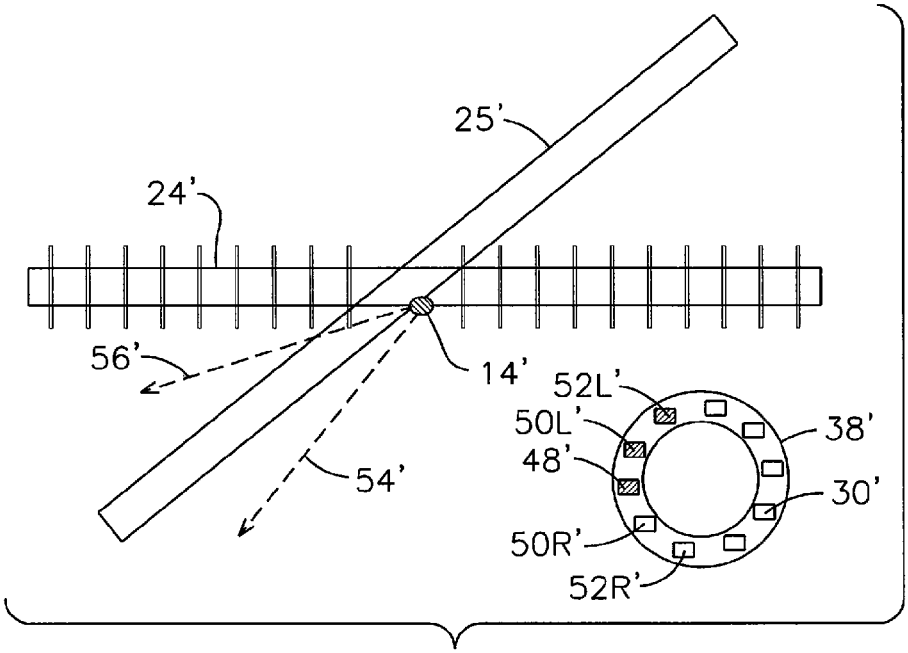
FIG. 9 is a top view of an embodiment of a system for sensing misalignment of a railroad signaling system according to the present invention.

Additionally, in the exemplary embodiment of FIGS. 7-9, the memory 60' stores misalignment threshold granularity to determine whether the received sensed detection information of the transmitter 26' by the plurality of receivers 30' is indicative of misalignment. The misalignment threshold granularity may include a maximum number of adjacent receivers 50' to the calibration receiver 48' to detect the transmitter 26' beyond which is indicative of misalignment. Accordingly, in the illustrated exemplary embodiment of FIGS. 8-9, as the vertical tube 16' (and horizontal alignment of the railroad signal 14') progressed from proper alignment (FIG. 8) with the roadway 25' to misalignment with the roadway 25' (FIG. 9), the electronic device 34' sensed a variation in the detection of the transmitter 26' from the calibration receiver 48' to a plurality of receivers 48',50L',52L' or 48',50R',52R', and communicated this sensed variation to the processor 58'. The plurality of receivers 48',50L',52L' or 48',50R',52R' extend beyond the maximum number of adjacent number of receivers 50L' or 50R' stored in the memory 58' (i.e., one) from the calibration receiver 48', thereby indicating misalignment of the vertical tube 16' (and railroad signaling system 12'). The misalignment threshold granularity, including a maximum number of adjacent receivers from the calibration receiver, may correspond to a maximum rotational deviation of the vertical tube indicative of misalignment, and such maximum rotational deviation may additionally be stored in the memory. Those other elements of the system 10' not discussed herein, are similar to those of the system 10 described above, indicated with prime notation, and require no further discussion herein.

Figure 10:
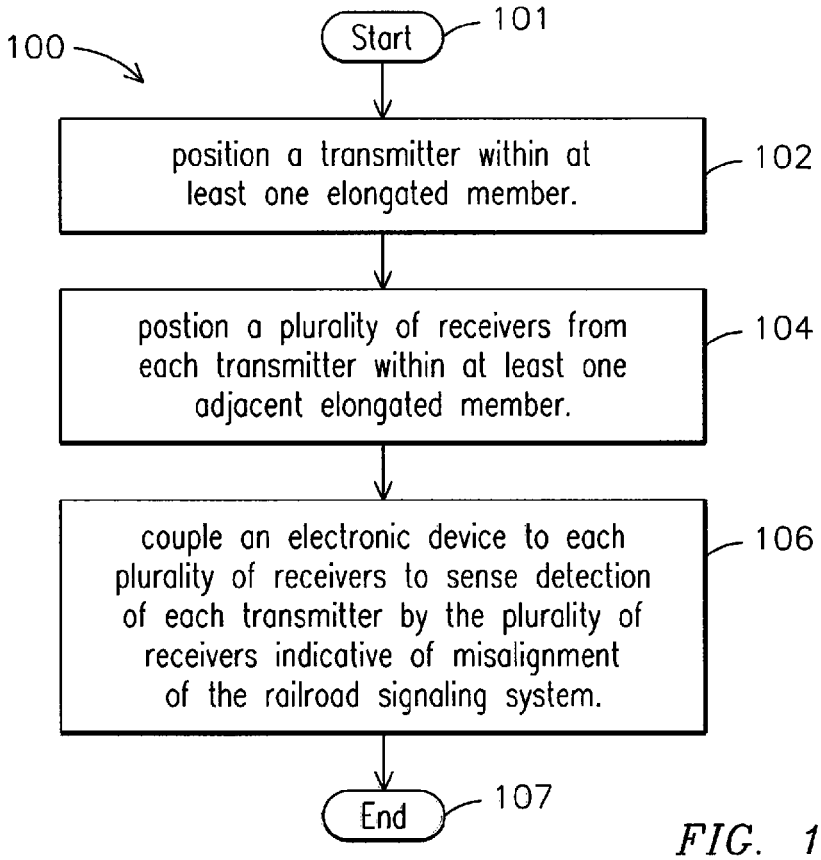
FIG. 10 is a flow chart illustrating an exemplary method embodiment of the system illustrated in FIG. 1.

FIG. 10 illustrates a method 100 to sense misalignment of a railroad signaling system 12. The railroad signaling system 12 illustratively includes a plurality of railroad signals 14 coupled to a plurality of elongated members 16,16A,18,18A, 20,22 adjacent to a railroad 24. In the illustrated exemplary embodiment of FIGS. 1-2, the plurality of elongated members 16,16A,18,18A,20,22 include vertical tubes 16,16A extending from each railroad signal 14, horizontal tubes 18,18A connected to the vertical tube 16, a horizontal bar 20 coupled to the horizontal tube 18,18A and a vertical bar 22 coupled to the horizontal bar which extends into the ground adjacent to the railroad 24. The vertical tube 16A and horizontal tube 18A are positioned respectively adjacent to the vertical tube 16 and horizontal tube 18, as illustrated in FIG. 2. The system 10 is not limited to the specific railroad signaling system 12 arrangement of elongated members 16A,16, 18A,18,20,22 in the illustrated exemplary embodiment of FIGS. 1-2, and may be utilized with a railroad signaling system including elongated members without a horizontal bar, vertical bar, and having diagonal bars, or any arrangement of elongated members supporting railroad signals. Additionally, although FIG. 1 illustrates a plurality of elongated members supporting a plurality of railroad signals, the system 10 may be utilized with a single elongated member or a single railroad signal, as appreciated by one of skill in the art.

The system 10 may be used to sense misalignment of a variety of railroad signaling systems 12. For example, the system 10 may be used to sense misalignment of a railroad signaling system, such as the railroad crossing signaling system 12 illustrated in FIG. 1, with the roadway 25. The system 10 may achieve a proper alignment such that pedestrians and drivers in cars on the roadway 25 approaching the railroad 24 clearly see the railroad signals 14. Additionally, the system 10 may be used to sense misalignment of a railroad signaling system, such as a signaling system aligned along a railroad such that operators of locomotives traveling along the railroad clearly see the railroad signals, as appreciated by one of skill in the art.

As illustrated in the exemplary embodiment of FIG. 10, the method 100 begins (block 101) by positioning (block 102) a transmitter 26,28 within a respective elongated member 16A, 18A. Subsequently, the method 100 further includes positioning (block 104) a plurality of receivers 30,32 from each respective transmitter 26,28 within each respective elongated member 16,18. The method further includes coupling (block 106) an electronic device 34,36 to each plurality of receivers 30,32 to sense detection of each respective transmitter 26,28 by the plurality of receivers indicative of the misalignment of the railroad signaling system 12.

Based on the foregoing specification, the above-discussed embodiments of the invention may be implemented using computer programming or engineering techniques including computer software, firmware, hardware or any combination or subset thereof, wherein the technical effect is to sense misalignment of a railroad signaling system. Any such resulting program, having computer-readable code means, may be embodied or provided within one or more computer-readable media, thereby making a computer program product, i.e., an article of manufacture, according to the discussed embodiments of the invention. The computer readable media may be, for instance, a fixed (hard) drive, diskette, optical disk, magnetic tape, semiconductor memory such as read-only memory (ROM), etc., or any transmitting/receiving medium such as the Internet or other communication network or link. The article of manufacture containing the computer code may be made and/or used by executing the code directly from one medium, by copying the code from one medium to another medium, or by transmitting the code over a network.

One skilled in the art of computer science will easily be able to combine the software created as described with appropriate general purpose or special purpose computer hardware, such as a microprocessor, to create a computer system or computer sub-system of the method embodiment of the invention. An apparatus for making, using or selling embodiments of the invention may be one or more processing systems including, but not limited to, a central processing unit (CPU), memory, storage devices, communication links and devices, servers, I/O devices, or any sub-components of one or more processing systems, including software, firmware, hardware or any combination or subset thereof, which embody those discussed embodiments the invention.

This written description uses examples to disclose embodiments of the invention, including the best mode, and also to enable any person skilled in the art to make and use the embodiments of the invention. The patentable scope of the embodiments of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

That which is claimed is:

1. A system for sensing misalignment of a railroad signaling system comprising at least one railroad signal coupled to at least one elongated member adjacent to a railroad, said system comprising:

at least one transmitter positioned within said at least one elongated member;

at least one receiver positioned from each of said at least one transmitter within at least one adjacent elongated member to said at least one elongated member;

at least one electronic device coupled to each of said transmitter and of said at least one receiver, for sensing misalignment of said railroad signaling system.

2. The system for sensing misalignment of a railroad signaling system according to claim 1, wherein said at least one transmitter comprises one transmitter positioned within said at least one elongated member and proximately positioned from each of said at least one receiver; and wherein said at least one electronic device comprises one electronic device coupled to each of said transmitter and of said at least one receiver.

3. The system for sensing misalignment of a railroad signaling system according to claim 2, wherein said at least one elongated member comprises at least one vertical tube extending out from said railroad signal, at least one horizontal tube connected to said at least one vertical tube, a horizontal bar coupled to said at least one horizontal tube and a vertical bar coupled to said horizontal bar and extending into a ground adjacent to said railroad;

and wherein said at least one transmitter and said at least one receiver are positioned within said at least one vertical tube and said at least one horizontal tube.

4. The system for sensing misalignment of a railroad signaling system according to claim 3, wherein said transmitter and said at least one receiver comprise a respective LED transmitter and at least one LED receiver having narrow angle spreads.

5. The system for sensing misalignment of a railroad signaling system according to claim 4, wherein said transmitter is mounted on respective inside surfaces of said vertical tube and said horizontal tube, and said at least one receiver are mounted on a ring coupled to the respective inside surfaces of an adjacent vertical tube and an adjacent horizontal tube.

6. The system for sensing misalignment of a railroad signaling system according to claim 5, wherein said transmitter and said at least one receiver within each of said vertical tubes and said horizontal tubes are proximately separated by a proximate distance based upon said narrow angle spread of each LED transmitter and said at least one LED receiver.

7. The system for sensing misalignment of a railroad signaling system according to claim 5, wherein said transmitter is mounted to the respective inside surfaces of said vertical tube and said horizontal tube and said ring coupled to the respective inside surfaces of said adjacent vertical tube and said adjacent horizontal tube includes a center hole to facilitate passage of a cable through said vertical tubes and said horizontal tubes to said railroad signal.

8. The system for sensing misalignment of a railroad signaling system according to claim 3, wherein said transmitter and said at least one receiver are positioned within a plurality of said adjacent vertical tubes for sensing horizontal misalignment of said railroad signal, and wherein said transmitter and said at least one receiver are positioned within a plurality of said adjacent horizontal tubes for sensing vertical misalignment of said railroad signal.

9. The system for sensing misalignment of a railroad signaling system according to claim 2, wherein said sensing misalignment of said railroad signaling system comprises sensing a variation of said transmitter by at least one receiver of said at least one receiver.

10. The system for sensing misalignment of a railroad signaling system according to claim 9, wherein said sensing a variation in the detection of said transmitter by at least one receiver of said at least one receiver comprises sensing a variation from a single receiver detecting said transmitter to one of at least one adjacent receiver detecting said transmitter.

11. The system for sensing misalignment of a railroad signaling system according to claim 2, wherein said electronic device is switchable between a calibration mode for sensing a proper alignment of said transmitter by at least one calibration receiver of said at least one receiver and recording proper alignment data in a memory within said electronic device including an identity of each calibration receiver; wherein upon recording said proper alignment data within said memory, said electronic device switches from said calibration mode into a detection mode for said sensing detection of each transmitter indicative of said misalignment of said railroad signaling system.

12. The system for sensing misalignment of a railroad signaling system according to claim 11, wherein said memory stores misalignment threshold granularity for determining whether said sensing detection of each transmitter by at least one receiver of said at least one receiver is indicative of said misalignment.

13. The system for sensing misalignment of a railroad signaling system according to claim 12, wherein said misalignment threshold granularity comprises a maximum number of adjacent receivers to said at least one calibration receiver for detecting each transmitter beyond which is indicative of misalignment.

14. The system for sensing misalignment of a railroad signaling system according to claim 13, wherein said electronic device is further switchable from said detecting mode to an alert mode upon detecting misalignment of said railroad signaling system for communicating an alert signal to a remote terminal to arrange for realignment of said railroad signaling system.

15. The system for sensing misalignment of a railroad signaling system according to claim 1, further comprising a processor coupled to each electronic device, said processor switchable to a calibration mode for receiving the identity of at least one calibration receiver when sensing a proper alignment of each transmitter in the calibration mode, said processor including a memory for storing proper alignment data including the identity of each calibration receiver; wherein upon recording said proper alignment data within said memory, said processor switches from said calibration mode into a detection mode for receiving sensed detection information from said electronic device of each transmitter by at least one receiver of said at least one receiver indicative of said misalignment of said railroad signaling system.

16. The system for sensing misalignment of a railroad signaling system according to claim 15, wherein said memory stores misalignment threshold granularity for determining whether said received sensed detection information of each transmitter by at least one receiver of said at least one receiver is indicative of said misalignment;

wherein said misalignment threshold granularity comprises a maximum number of adjacent receivers to said at least one calibration receiver for detecting each transmitter beyond which is indicative of misalignment.

17. A method for sensing misalignment of a railroad signaling system comprising at least one railroad signal coupled to at least one elongated member adjacent to a railroad, said method comprising:

positioning at least one transmitter within said at least one elongated member;

positioning at least one receiver from each of said at least one transmitter within at least one adjacent elongated member to said at least one elongated member;

coupling at least one electronic device to each of said at least one receiver, for sensing misalignment of said railroad signaling system.

18. The method for sensing misalignment of a railroad signaling system according to claim 17, wherein said at least one transmitter comprises one transmitter positioned within said at least one elongated member and proximately positioned from each of said at least one receiver; and wherein at least one electronic device comprises one electronic device coupled to each of said at least one receiver;

wherein said at least one elongated member comprises a plurality of vertical tubes extending out from said railroad signal, a plurality of horizontal tubes connected to said vertical tubes, a horizontal bar coupled to said horizontal tubes and a vertical bar coupled to said horizontal bar and extending into a ground adjacent to said railroad;

and wherein said transmitter and said at least one receiver are positioned within said vertical tubes and said horizontal tubes.

19. The method for sensing misalignment of a railroad signaling system according to claim 18, wherein said transmitter and said at least one receiver comprise a respective LED transmitter and at least one LED receiver having narrow angle spreads.

20. The method for sensing misalignment of a railroad signaling system according to claim 19, wherein said positioning said transmitter within at least one elongated member comprises mounting said transmitter on a respective inside surfaces of said vertical tube and said horizontal tube;

and wherein said proximately positioning at least one receiver from said transmitter within said one of at least one adjacent elongated member comprises mounting said at least one receiver on a ring coupled to the respective inside surfaces of an adjacent vertical tube and an adjacent horizontal tube.

21. The method for sensing misalignment of a railroad signaling system according to claim 20, wherein upon said mounting said transmitter to the respective inside surfaces of said vertical tube and said horizontal tube and said coupling each ring to the respective inside surfaces of said adjacent vertical tube and said adjacent horizontal tube, said method further includes passing a cable for said railroad signal through a center hole of each ring and through said vertical tubes and said horizontal tubes to said railroad signal.

22. The method for sensing misalignment of a railroad signaling system according to claim 18, wherein said transmitter and said at least one receiver are positioned within said vertical tubes for sensing horizontal misalignment of said railroad signal, and wherein said transmitter and said at least one receiver are positioned within said horizontal tubes for sensing vertical misalignment of said railroad signal.

23. The method for sensing misalignment of a railroad signaling system according to claim 18, wherein said sensing misalignment of said railroad signaling system comprises sensing a variation in the detection of said transmitter by said at least one receiver.

24. The method for sensing misalignment of a railroad signaling system according to claim 23, wherein said sensing a variation in the detection of said transmitter by said at least one receiver comprises sensing a variation from a single receiver detecting said transmitter to one of at least one adjacent receiver detecting said transmitter.

25. The method for sensing misalignment of a railroad signaling system according to claim 18, wherein said electronic device is switchable between a calibration mode for sensing a proper alignment of said transmitter by at least one calibration receiver of said at least one receiver and recording proper alignment data in a memory within said electronic device including the identity of each calibration receiver; wherein upon recording said proper alignment data within said memory, said electronic device switches from said calibration mode into a detection mode for said sensing detection of each transmitter by said at least one receiver indicative of said misalignment of said railroad signaling system.

26. The method for sensing misalignment of a railroad signaling system according to claim 25, wherein said memory stores misalignment threshold granularity for determining whether said sensing detection of each transmitter by at least one receiver of said at least one receiver is indicative of said misalignment;

and wherein said misalignment threshold granularity comprises a maximum number of adjacent receivers for detecting each transmitter relative to said at least one calibration receiver beyond which is indicative of misalignment.

27. The method for sensing misalignment of a railroad signaling system according to claim 26, wherein said electronic device is further switchable from said detecting mode to an alert mode upon detecting misalignment of said railroad signaling system for communicating an alert signal to a remote terminal to arrange for realignment of said railroad signaling system.

28. The method for sensing misalignment of a railroad signaling system according to claim 18, further comprising a processor coupled to each electronic device, said processor switchable to a calibration mode for receiving the identity of at least one calibration receiver for sensing a proper alignment of said transmitter in the calibration mode, said processor including a memory for storing proper alignment data including the identity of each calibration receiver; wherein upon recording said proper alignment data within said memory, said processor switches from said calibration mode into a detection mode for receiving sensed detection information from said electronic device of said transmitter by at least one receiver of said at least one receiver indicative of said misalignment of said railroad signaling system.

29. The method for sensing misalignment of a railroad signaling system according to claim 28, wherein said memory stores misalignment threshold granularity for determining whether said received sensed detection information from said electronic device of each transmitter by said at least one receiver is indicative of said misalignment;

and wherein said misalignment threshold granularity comprises a maximum number of adjacent receivers for detecting said transmitter relative to said at least one calibration receiver beyond which is indicative of misalignment.

* * * * *